US010827286B2

(12) United States Patent
Hendrikse

(10) Patent No.: US 10,827,286 B2
(45) Date of Patent: Nov. 3, 2020

(54) HEARING DEVICE WITH SPATIAL CUE INFORMATION PROCESSING CAPABILITY

(71) Applicant: GN Hearing A/S, Ballerup (DK)

(72) Inventor: Antonie Johannes Hendrikse, Eindhoven (NL)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 15/339,539

(22) Filed: Oct. 31, 2016

(65) Prior Publication Data

US 2017/0180877 A1 Jun. 22, 2017

(30) Foreign Application Priority Data

Dec. 22, 2015 (EP) ..... 15201918

(51) Int. Cl.
*H04R 25/00* (2006.01)

(52) U.S. Cl.
CPC ..... *H04R 25/407* (2013.01); *H04R 25/305* (2013.01); *H04R 25/35* (2013.01); *H04R 25/505* (2013.01); *H04R 25/552* (2013.01); *H04R 2460/03* (2013.01)

(58) Field of Classification Search
CPC .... H04R 25/407; H04R 25/305; H04R 25/35; H04R 25/505; H04R 25/552; H04R 2460/03
USPC ..... 381/23.1, 312
See application file for complete search history.

(56) References Cited

U.S. PATENT DOCUMENTS 7,020,296 B2 * 3/2006 Niederdrank ..... H04R 25/453 381/312
2009/0304203 A1 * 12/2009 Haykin ..... G10L 21/02 381/94.1
2010/0002886 A1 * 1/2010 Doclo ..... H04R 25/552 381/23.1
2013/0051565 A1 2/2013 Pontoppidan
(Continued)

FOREIGN PATENT DOCUMENTS

CN 101547394 A 9/2009
CN 103458347 A 12/2013
(Continued)

OTHER PUBLICATIONS

Extended European Search Report dated Jun. 28, 2016, for corresponding EP Patent Application No. 15201918.8, 10 pages.
(Continued)

*Primary Examiner* — Ahmad F. Matar
*Assistant Examiner* — Sabrina Diaz
(74) *Attorney, Agent, or Firm* — Vista IP Law Group, LLP

(57) ABSTRACT

A hearing device includes: a sound analyser configure to receive a sound signal and determine a contribution of at least one sound source associated with the sound signal; a difference estimator coupled to the sound analyser, and configured to estimate spatial cue information of the at least one sound source for storage in the hearing device; and a communication device configured to receive from a second hearing device information related to the at least one sound source; wherein the difference estimator is configured to update the stored spatial cue information of the at least one sound source based on the information received by the communication device.

41 Claims, 5 Drawing Sheets

(56) References Cited

U.S. PATENT DOCUMENTS

| | | | | |
|---|---|---|---|---|
| 2014/0044291 | A1* | 2/2014 | Xia | H04R 25/50 381/321 |
| 2015/0124975 | A1* | 5/2015 | Pontoppidan | H04R 25/552 381/23.1 |
| 2016/0360326 | A1* | 12/2016 | Bergmann | H04R 25/554 |

FOREIGN PATENT DOCUMENTS

| | | | |
|---|---|---|---|
| CN | 104618843 | A | 5/2015 |
| CN | 104980865 | A | 10/2015 |
| EP | 2 563 045 | A1 | 2/2013 |
| EP | 2 696 602 | A1 | 2/2014 |
| EP | 2 869 599 | A1 | 5/2015 |

OTHER PUBLICATIONS

First Office Action dated May 27, 2019 for corresponding Chinese Patent Application No. 201611222012.4, 25 pages.
Second Office Action (Notification of Rejection) dated Sep. 10, 2019, for corresponding JP Patent Application No. 2016-248207, 17 pages.
EP Communication Pursuant to Article 94(3) dated Jul. 20, 2020 for corresponding European Patent Application No. 15201918.8.

* cited by examiner

HEARING DEVICE WITH SPATIAL CUE INFORMATION PROCESSING CAPABILITY

RELATED APPLICATION DATA

This application claims priority to, and the benefit of, European Patent Application No. EP 15201918.8 filed Dec. 22, 2015, pending. The entire disclosure of the above-identified application is expressly incorporated by reference herein.

FIELD

The present disclosure relates to a system of hearing devices, and to a method for spatial cue tracking.

BACKGROUND

The position of sound sources and the physical properties of the listening environment affect the sound perceived by a listener. Such effects are commonly denoted as spatial cues. These spatial cues are detected and used in the auditory system to facilitate selective listening and build an acoustic model of the sound environment. Hearing device signal processing can distort existing spatial cues and add distortion. This is experienced as spatial cue, which do not match with the actual position of the source. For example the distortion introduced by the hearing aid may for example indicate a shift of the position of the source.

SUMMARY

There is a desire to further improve spatial cue detection and processing.

The present disclosure proposes a hearing device comprising a sound analyser configure to receive a sound signal and determine a contribution of at least one sound source in the sound signal. A difference estimator is coupled to the sound analyser and configured to estimate and to store spatial cue information of the at least one sound source. A communication device configured to receive from a second hearing device information related to the at least one sound source. In accordance with the present disclosure the difference estimator is configured to update the stored spatial cue information of the at least one sound source based on the information received by the communication device.

The disclosure enables to provide suitable spatial cue information to restore even for hearing aids, which do not continuously synchronise due to power consumption requirements. To maintain the sensitivity provided by the human auditory system, the spatial cue information estimated is stored and updated on a regular basis, whereby the update period can exceed the time, the human auditory system is particularly sensitive to such spatial cue.

In this regard, the term "spatial cue information" may refer to spatial cue information in the time domain or in power level, that is spatial cue on Interaural level difference (ILD) and interaural time difference (ITD). Likewise, the difference estimator may comprise ILD estimator, an ITD estimator or a combination of both.

The term sound signal may generally comprise an audible signal from one or more sound sources. The sound sources can be of different nature and may interfere with each other. Generally, some of these sound sources can be associated with noise, while others may contain usable information, like speech, music, voice etc. In other words a sound signal may comprise a noise portion (from sound signals not of interest to the listener) often qualified as background noise and a sound portion (from the sound source of interest to the listener)

In an aspect the hearing device may comprise a compressor configured to amplify the received sound signal or parts thereof in response to the estimated spatial cue information by the difference estimator. The compressor may output the amplified sound signal to a listener. The amplification can be frequency dependant and/or amplitude dependant and may be adjusted based on the estimated spatial cue information. This allows adjusting the output level of the sound source based on the estimated spatial cue supporting the auditory system of a listener to locate a position of the sound source in space.

In another aspect, the hearing device comprises a sound source tracker configured to detect an activity of the at least one sound source and in response to said detection restore spatial cue of the at least one sound source based on the stored spatial cue information. Consequently, the hearing device may adjust the level of the received sound signal assigned to said source only when an activity of the sound source is detected. Such activity may include level or tone variation of the sound source, a slow movement of the sound source and the like. It may be suitable in some aspects that the difference estimator is configured to update the stored spatial cue information of the at least one sound source upon detection of an activity by the source tracker.

Some other aspects are related to the communication device. The communication device may be configured to transmit data related to spatial cue information of the at least one sound source or the received sound signal or more generally to synchronize data related to spatial cue information of the at least one sound source with the second hearing device. The latter implementation may be suitable if there are two hearing devices supporting the same listener. The two hearing devices may exchange information related to ILD or ITD prediction on a periodic basis. Generally, such information related to said at least one sound source may comprise an observed power of a sound signal over a certain period of time or at a certain point in time or a combination thereof. Alternatively, it may comprise an observed power of a sound signal depending on predetermined frequency bands. It may also comprise an observed power of the at least one sound source over a certain period of time or at a certain point in time or a combination thereof. Yet alternatively it may comprise observed power of another one of the at least one sound source over a certain period of time or at a certain point in time or a combination thereof. Finally one or more of the above information can be combined. In another aspect, the information may comprise phase information about the sound signal, for instance a phase difference to a certain reference. It may comprise the phase difference between two identified sound sources. In this regard a phase or phase difference corresponds to a time or time difference. Consequently, the information may comprise a time stamp assigned to a portion of the sound signal. If the time is synchronised between the hearing devices a time stamp enable the hearing device to determine the time difference of the sound signal being recorded between the hearing device. In yet another aspect the information may contain spatial cue information assigned to the sound source, wherein the sound source is uniquely identified by both hearing devices, i.e. by a common identifier. Communication may use Bluetooth standard, various protocols for near field communication or any other suitable protocol with reduced power consumption and/or reduced usage of bandwidth.

The communication device is configured to communicate with the other hearing device upon a predetermined time period. Such time period may be agreed upon by both hearing devices. Alternatively, the communication can be triggered upon detection of activity of the at least one sound source exceeding a predetermined activity threshold. In some aspects, the communication is triggered by said activity and initiated at a certain time thereafter. This reduces the frequency of communication, if there is no change in spatial cue information and only exchange information when suitable, thereby reducing power consumption.

In yet another aspect is related to a method for restoring spatial cue information in a hearing device. The method proposes identifying at least one sound source in a received sound signal and estimating spatial cue information of the at least one sound source. The spatial cue information is stored. Further, external information related to the at least one sound source is received and the stored spatial cue information of the at least one sound source is updated based on the received external information.

The information received can include observed power of a sound signal over a certain period of time, at a certain point in time in a determined frequency band or a combination thereof. Alternatively power of the at least one sound source can be observed, similar to the sound signal. Further, information about power of another sound source can be received.

In some aspects of the present disclosure, an activity of the at least one sound source is detected and spatial cue of the at least one sound source is restored in response thereto and based on the stored spatial cue information.

The method can be used in a hearing device, a hearing aid or a hearing protection for example. Likewise, the hearing device disclosure above can be part of a hearing aid or a hearing protector.

A hearing device includes: a sound analyser configure to receive a sound signal and determine a contribution of at least one sound source associated with the sound signal; a difference estimator coupled to the sound analyser, and configured to estimate spatial cue information of the at least one sound source for storage in the hearing device; and a communication device configured to receive from a second hearing device information related to the at least one sound source; wherein the difference estimator is configured to update the stored spatial cue information of the at least one sound source based on the information received by the communication device.

Optionally, the hearing device is configured to adjust at least a part of the received sound signal based on the adjusted spatial cue information to provide an adjusted sound signal, and wherein the hearing device further comprises a compressor configured to compress the adjusted sound signal.

Optionally, the compressor is configured to compress the adjusted sound signal in frequency and/or amplitude.

Optionally, the hearing device further includes a sound source tracker configured to detect an activity of the at least one sound source, and in response to the detection activity, restore spatial cue of the at least one sound source based on the stored spatial cue information.

Optionally, the sound source tracker is configured to weight the stored spatial cue information with a probability that the sound signal is related to the at least one sound source.

Optionally, the hearing device further includes a sound source tracker configured to detect an activity of the at least one sound source, wherein the difference estimator is configured to update the stored spatial cue information of the at least one sound source upon detection of the activity by the sound source tracker.

Optionally, the difference estimator is configured to update the stored spatial cue information of the at least one sound source by performing a at least one of: determining a difference between the stored spatial cue information and an observed spatial cue information; combining the stored spatial cue information of the at least one sound source with another spatial cue information of another sound source; weighting of the stored spatial cue information with a probability that the sound signal is related to the at least one sound source.

Optionally, the communication device is configured to transmit data related to the received sound signal or to spatial cue information of the at least one sound source, or wherein the communication device is configured to synchronize data related to spatial cue information of the at least one sound source with the second hearing device.

Optionally, the information related to the at least one sound source comprises at least one of: observed sound signal power over a certain period of time, at a certain point in time, or a combination thereof; observed sound signal power depending on predetermined frequency bands; observed power of the at least one sound source over a certain period of time, at a certain point in time, or a combination thereof; observed power of another sound source over a certain period of time, at a certain point in time, or a combination thereof; an averaged observed power of any of the above; phase information about the sound signal or about the at least one sound source; additional spatial cue information or source activity; a combination of two or more of the foregoing.

Optionally, the communication device is configured for wireless communication according to a Bluetooth standard, a Bluetooth low energy (BLE) protocol, or a protocol for near field communication (NFC).

Optionally, the communication device is configured to communicate with the second hearing device upon (2) a lapse of a predetermined time period, (2) a detection of an activity of the at least one sound source exceeding a predetermined activity threshold, or (3) a combination of the foregoing.

Optionally, the sound analyser is further configured to determine or estimate a noise source in the sound signal, or wherein the sound analyser is configured to separate a voice portion in the sound signal from a non-voice portion.

Optionally, the sound analyser is configured to determine or estimate a contribution of the at least one sound source by comparing the received sound signal to a threshold value.

Optionally, the sound analyser is configured to set the hearing device in a first operating mode if the contribution of the at least one sound source is below a threshold value, and to set the hearing device in a second operating mode if the contribution of the at least one sound source is above the threshold value.

Optionally, the spatial cue information includes a first spatial cue information related to a noise portion in the sound signal and a second spatial cue information related to a voice portion in the sound signal, and wherein the hearing device further includes a memory to store the first spatial cue information related to the noise portion in the sound signal, and the second spatial cue information related to the voice portion in the sound signal.

Optionally, the hearing device further includes a memory, and wherein the difference estimator is configured to store the spatial cue information in a predetermined memory portion of the memory depending on the first operating mode and/or the second operating mode.

Optionally, the hearing device comprises a hearing protector or a hearing aid.

A method performed by a hearing device includes: identifying at least one sound source in a received sound signal; estimating spatial cue information of the at least one sound source; storing the spatial cue information; receiving external information related to the at least one sound source; and updating the stored spatial cue information of the at least one sound source based on the received external information.

Optionally, the method further includes: detecting an activity of the at least one sound source; and restoring spatial cue of the at least one sound source in response to the detected activity, and based on the stored spatial cue information Optionally, the method further includes updating the stored spatial cue information of the at least one sound source based on a detection of an activity of the at least one sound source.

Optionally, the method further includes synchronizing external information related to the at least one sound source with a second hearing device, wherein the external information comprises one of: observed sound signal power over a certain period of time, at a certain point in time, or a combination thereof; observed sound signal power depending on predetermined frequency bands; observed power of the at least one sound source over a certain period of time, at a certain point in time, or a combination thereof; observed power of another sound source over a certain period of time, at a certain point in time, or a combination thereof; additional spatial cue information of the sound signal or source activity; or a combination of two or more of the foregoing.

Optionally, the method further includes repeating the acts of receiving and estimating, wherein the acts of receiving the external information are performed less frequent than the acts of estimating spatial cue information.

Other features, embodiments, and advantageous will be described in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
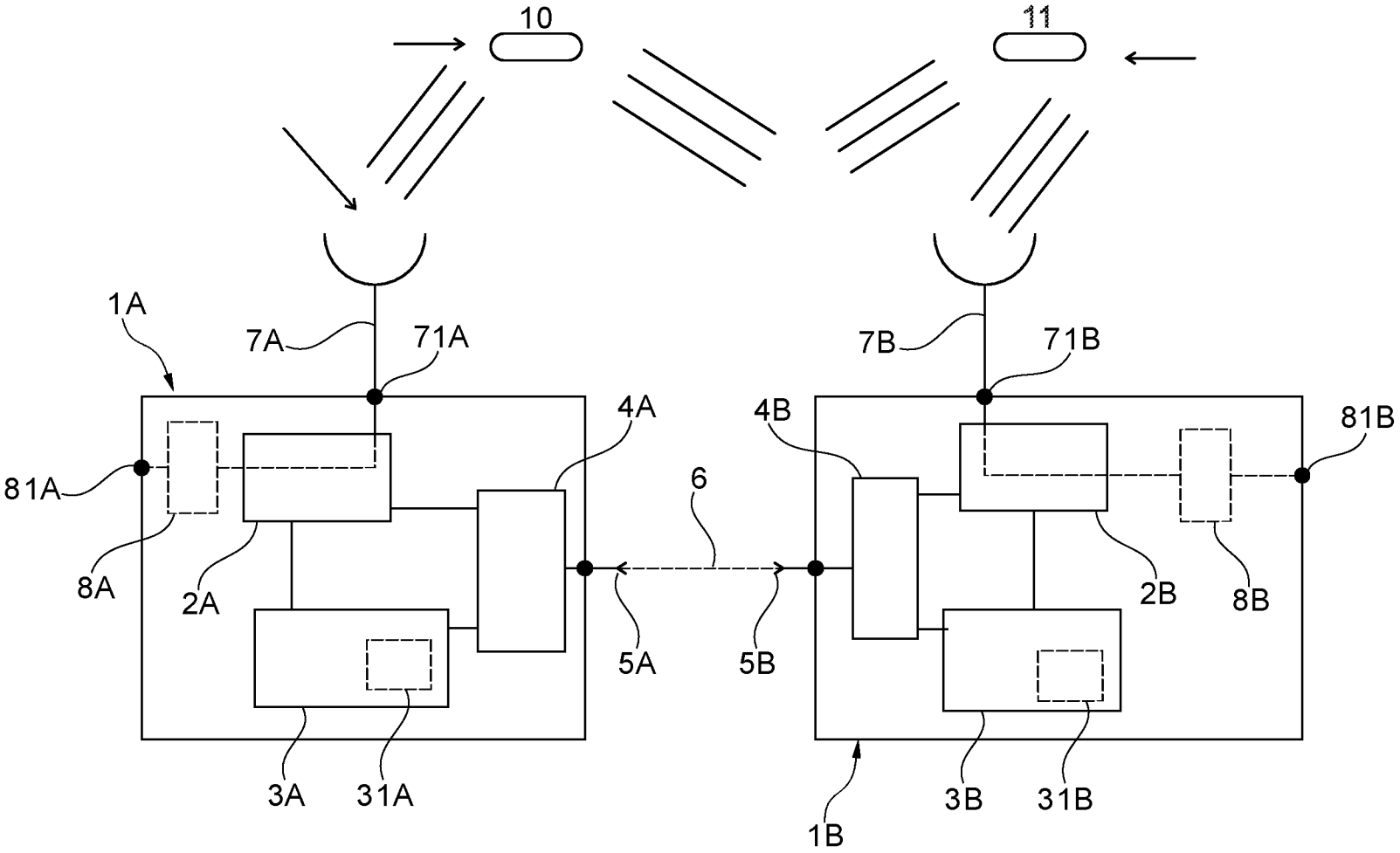
FIG. 1 illustrates an embodiment of the present disclosure showing two hearing devices.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments.

They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described. Throughout, the same reference numerals are used for identical or corresponding parts.

The human auditory system is capable of locating sound sources in space based on the phase and time delay information as well as on the power level of such sources. This is called interaural time difference (ITD) and interaural level difference (ILD). The ITD originates from the fact that a sound from a source may take different time to reach the right and left ear, respectively. Interaural level difference can be due to obstacles in the sound path, for instance the head of the listeners attenuating the sound, also called head shadow. By processing both differences, the listener can not only obtain information about the location but more generally build an acoustic model of the sound environment. For example, human auditory processing can identify a direct sound path form a sound source and may interpret the same sound signals (but different in level) with a delay larger than 20 ms as reverberation.

Figure 5A:
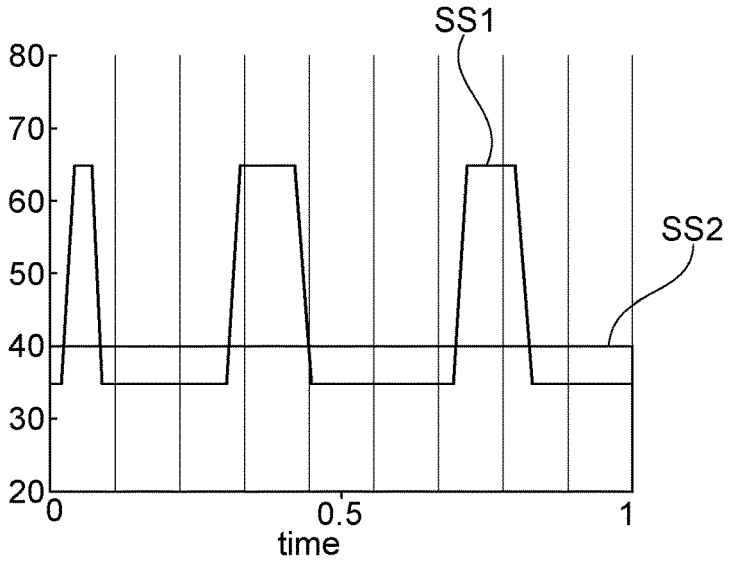
FIG. 5A shows a diagram illustrating the effect of spatial cue information in audio signals.
Figure 5B:
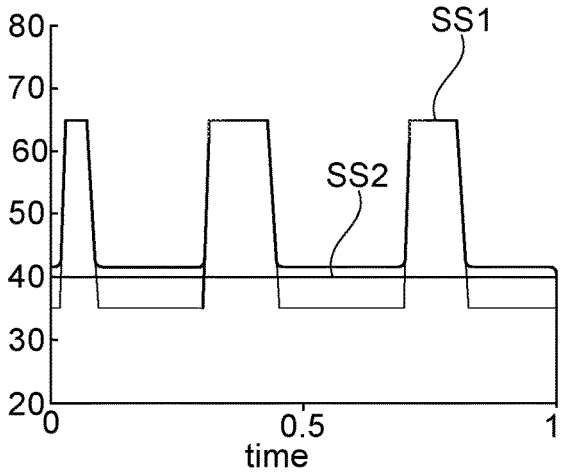
FIG. 5B shows a diagram illustrating the effect of spatial cue information in audio signals.
Figure 5C:
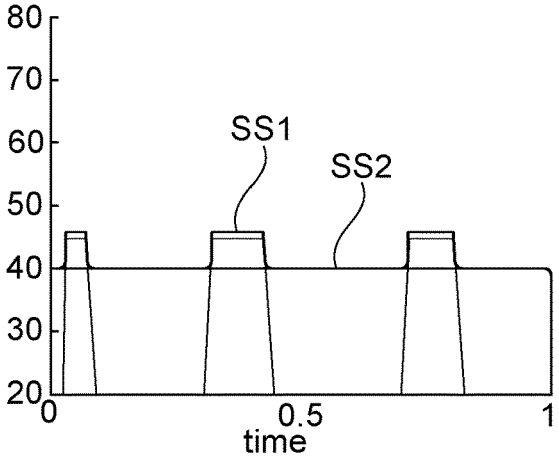
FIG. 5C shows a diagram illustrating the effect of spatial cue information in audio signals.

FIG. 5A to 5C show an arbitrary level-time diagram of different sounds and how these are received by the listener. The overall sound signal in the example according to FIG. 5A is a combination of a background noise sound SS2 and sound SS1 providing information of interest to the listener. SS1 can be for example voice; the listener wants to listen to signal SS1, while SS2 contains a combination of sound generated by several other sound sources not of particular interest. A typical real life example is in a crowd of people, where the listener listens to a single voice, while other voices are perceived as background noise. The background noise SS2 is stable over time and at the same level on the left ear at FIG. 5B and on the right ear illustrated on FIG. 5C. Voice sound SS1 is varying over time. Further, the location of SS1 is not in front of the listeners but located on one of its side. This location results in a higher level on the left ear at FIG. 5B than on the right ear. In other words the signal-to-noise ratio is higher on the left ear. The auditory system can use this spatial cue information locate the sound source in space generating signal SS1.

FIG. 1 illustrates a similar situation this time with an embodiment of two hearing devices supporting a listener, who is audibly challenged. The hearing devices 1A and 1B record via respective microphones 7A and 7B sound signals from two spatially separated sound sources 10 and 11. Although only two sound sources are shown here, many more sound sources can be present at different power levels, locations and frequencies. The serval sound sources can be stationary or moving. The combination of the sound produced by the different sources is recorded at the hearing devices at microphones 7A and 7B, respectively and regarded as the overall sound signal. As illustrated in FIG. 1, the sound sources are located at different positions, source 11 being close to hearing device 1B than source 10 and vice versa. Under the assumption that both sound sources produce a constant sound level, the level of source 10 at microphone 7A is a bit larger than the level of said source on microphone 7B. Likewise the level of source 11 at microphone 7B is a bit larger than the level of said source on microphone 7A.

Previous hearing aid systems now amplified the recorded sound level to obtain a uniform output level for both hearing devices. This called independent compression resulted in a factual loss of spatial information as the output level of a sound source became very similar for both hearing devices. Consequently, bilateral compression was introduced, wherein information between the two hearing devices on the received power of the sound signal was exchanged. Such information was used in the hearing devices to adjust the amplification of the recorded sound signals to artificially introduce spatial cue information. While this improved the situation under specific circumstances, the required data capacity between the two hearing devices is significant. Further, sound sources may vary in level and spectrum faster than the update of such information exchange creating artificial artefacts resulting in the wrong acoustic model at the listener.

The two hearing devices 1A and 1B proposed here improve the situation by providing a difference prediction estimate taking some of the effects into account. The hearing devices may have hardware and software components or a combination of both and comprises various analogue and digital circuity. The different circuit are operatively coupled to achieve the functionality of the elements described further below.

Each hearing device comprises a microphone 7A, 7B connected to a sound analyser 2A and 2B, respectively. The sound analyser does not only pre-amplify the recorded sound to improve SNR, but is also configured to determine the contribution of one or more sound sources in the recorded signal. It may separate a specific sound form the overall sound signal, for example identify a voice sound signal and separate such signal from the background noise.

The sound analyser is connected with difference predictor, here in form of an ILD estimator. The ILD predictor estimates spatial cue information about the sound source and stores this information in memory 31A, 31B. In this regard "spatial cue information" estimated by the predictor 3A and 3B, respectively, can comprise ILD or ITD information, processed information thereof, like for example changes or difference of such ILD or ITD information and the like. For the purpose of estimating and storing such information, the predictor may use the level or contributions of the identified sound sources from the sound analyser. The predictor 3A and 3B also adjusts a corresponding gain in the optional compressor 8A and 8B, respectively. For this purpose the ILD predictor 3A and 3B uses stored information about the spatial cue, that is ILD information of all available identified and separated sound sources in the received sound signal.

In addition to the estimation of spatial cue information by the predictors of the individual hearing devices, the hearing devices are also configure to communicate with each other at periodic intervals via a wireless communication line 6. The communication may follow a certain wireless standard like for example, but not limited thereto, Bluetooth or NFC protocols. In any case the communication type as well as the information exchanged is selected such as to consume only a low amount of power.

Communication between the hearing devices is established by communication devices 4A and 4B, respectively, which are coupled to sound analyser 2A, 2B and predictor 3A, 3B. In an aspect, the communication devices exchange information about the average power level or the power level of a specific sound source. This exchange is performed at a lower rate than the individual prediction and analysis in the hearing devices.

Figure 2:
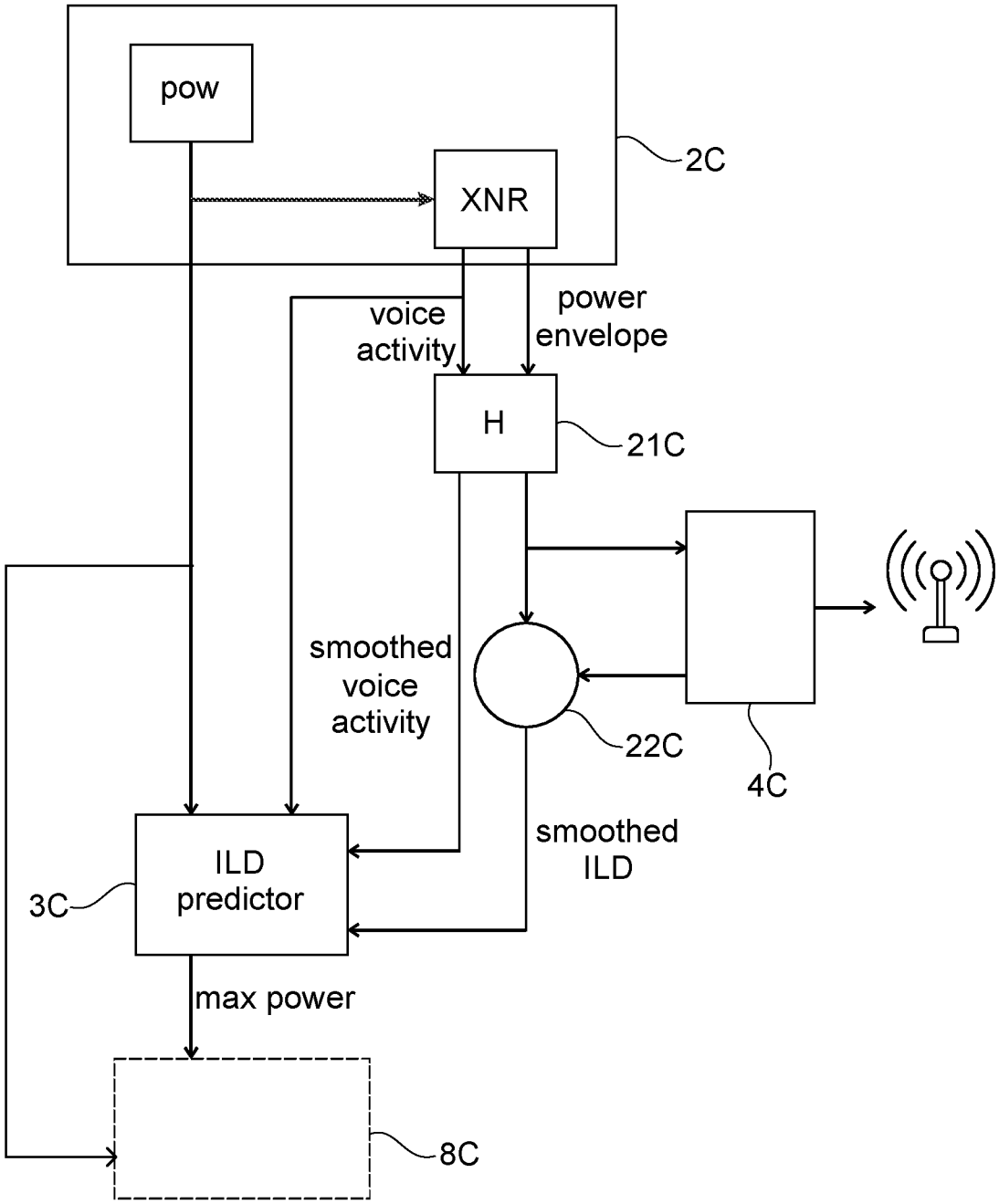
FIG. 2 shows a schematic view of a hearing device according to some aspects.

FIG. 2 shows several aspects of a hearing device in accordance with the present disclosure. Sound analyser 2C comprises a first analyser pow to obtain power levels in different frequency bands. Such information is forwarded to the compressor 8C and to the ILD predictor 3C. The block XNR separates the different sound sources and determines if voice sound is active. It also provides common power level envelope information, that is how the sound level changes over time. Such information may be useful to predict whether a sound source is moving or how the environment changes over time. Information about the voice activity is forwarded to the ILD predictor 3C. In addition, information about voice activity and the average power is forwarded to a smoothing unit 21C. The smoothed voice activity and the smoothed ILD estimate are used to update the ILD prediction per sound source. This function is performed at a much lower rate than the prediction using the information from the pow and XNR blocks.

In addition, the average power is communicated via the communication device 4C periodically to the second hearing device. The obtained information about the average power is used to generate a smoothed ILD forwarded to the predictor.

Figure 3:
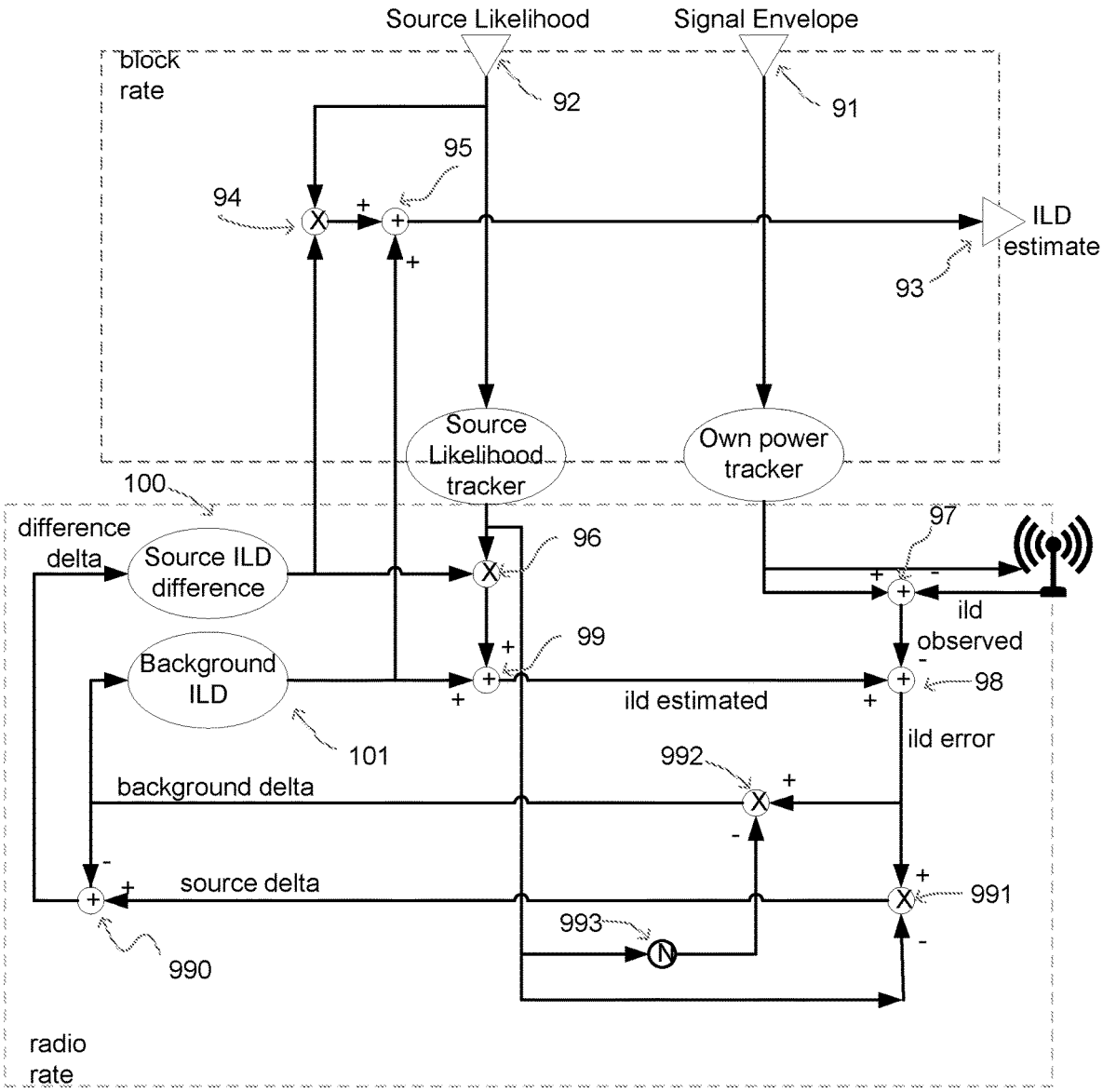
FIG. 3 shows another schematic view of several parts of an hearing aid.

FIG. 3 illustrate a schematic view of the functional blocks of the ILD predictor. At input 90 a signal is received indicating the likelihood of a sound signal belonging to a specific sound source, that is in the present non-limiting example a voice source or a background noise. The "likelihood" can be a value of some sort, but for the purpose of illustration of the functional block, one may simply call it likelihood. The likelihood is also applied to element 94 which together with element 95 weight the likelihood with the stored spatial cue information of the sound sources, that is the spatial cue information 100 of the voice source and the spatial cue information 101 about the background noise. The weighting in the present case can be associated with a multiplication between the spatial cue information 100 with the likelihood and then summing this information with the spatial cue information 101. As an example, if the likelihood of voice is very high, the multiplication in element 94 will result in a large value, thereby dominating the overall result at output 93. Likewise if the likelihood is very low, the spatial cue information 101 of the background noise will dominate. The output of the prediction at output 93 is used to adjust the gain in the compressor.

For estimating and updating the spatial cue information, the output of the prediction "ild predicted" is summed up in element 98. In the illustrated example "ild predicted" is generated using element 96 and 99, by respective multiplication and summing up the results with the background noise, but the result of the operation described above and applied to output 93 can also be used.

At input 91 a signal related to the average level, the signal envelope of the power level is applied. This average power level contains information about the previous development of the overall sound signal and is further communicated to the second hearing device as indicated by the antenna. A likewise obtained power level received from the second hearing aid is deducted from the power level envelope information. The result is the overall spatial cue information "ild observed". "Ild observed" is then deducted in element 98 from "ild predicted". The result represents the error denoted as "ild error". Depending on which of the identified sound sources were considered active, the error is used to update the spatial cue information in memory 100 and 101.

For this purpose the following functionality is provided. The ild estimate error "ild error" is applied multiplied with the likelihood value or the inverted likelihood value at functional element 991 and 992, respectively. Functional element 993 acts as an inverter. For example, if the probability for a recorded signal to originate from the voice source, then the estimate error "ild error" will also most likely contain voice information. The multiplication in elements 991 and 992 corresponds to a weighting, in which the "ild error", that is the spatial cue information error is weighted with the probability function of the sound sources stored in memory 100 and 101. The result for the background or noise spatial cue information denoted as "background delta" is obtained by the weighting of "ild error" with the inverted probability in functional element 992 is stored. The spatial cue information in memory 100 for the voice source is updated after deducting in element 990 from the weighted "ild error" the updated and weighted value for the spatial cue information on the background noise denoted as "background delta".

As an example, it is assumed that the two hearing devices receive a sound signal, said sound signal comprising noise and voice portion. The sound source for the voice portion is located closer to one hearing aid than to the other, or one hearing aid has an obscured sound path towards said sound source. Then, the level of the voice source is different between the two hearing aids, while the level for the noise is similar. This situation is similar to the one presented in FIG. 5. The different levels result in an average signal envelope, which is also different for the two hearing devices. Consequently, the deduction of the received signal envelope with the own obtained signal envelope results in a certain "ild observed". This observation is deducted from the estimated value to obtain the error. Under the assumption the error is large, that is the source moved or changed its level significantly. In the case, in which the source is considered to be just noise, that means the probability to be the voice source is low, the weighted source value of the error becomes small (after weighting in element 991). At the same time the weighting in element 992 results in a "background delta" error similar to the "ild error". Hence, the spatial cue information in memory 101 may change significantly after updating the memory, while due to the deduction, the spatial cue information in memory 100 may not even be updated.

In summary, the weighting functionality enables the estimator and sound analyser to update only the spatial cue information for the sound source which is considered relevant or was identified with a high probability in the sound signal.

Figure 4:
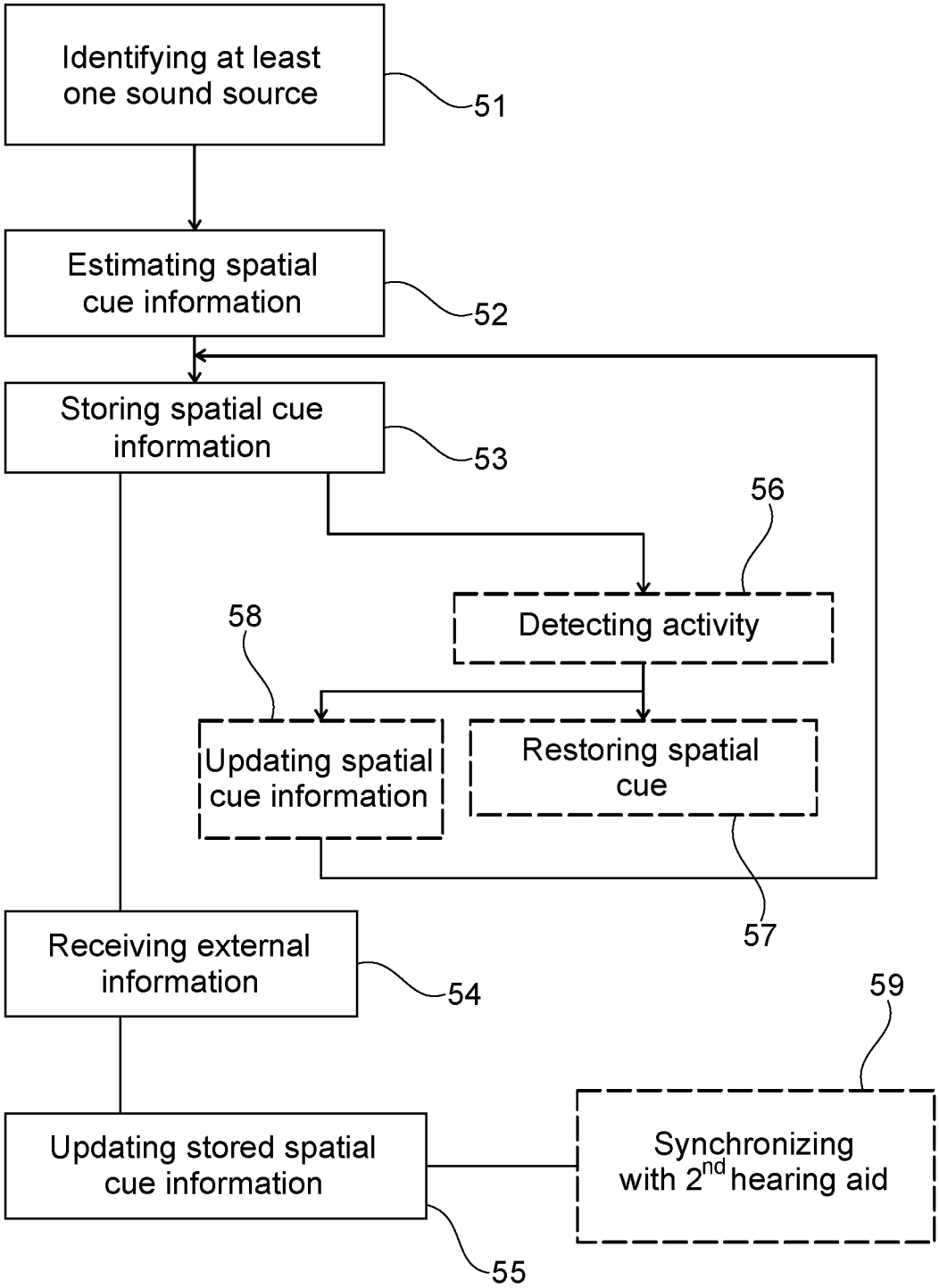
FIG. 4 shows an embodiments of a method for restoring spatial cue information.

FIG. 4 illustrates an embodiment of a method for restoring spatial cue information showing several aspect of the present disclosure. In a first step S1 the sound source or the sound sources are identified. Such identification can be performed for example by evaluating power level changes in certain frequency bands, which occur during speaking and are different from normal noise. For example under the assumption there are two different sound sources, one producing a voice, the other one some noise, then the different sound sources can be separated by evaluating the power level over time in frequency bands in which the voice portion is particular strong. These may be for example the medium and higher frequency bands, while voice level and noise level in the lower frequency band may be very similar and therefore difficult to separate, The information about the sound source, that is if a certain sound signal at a certain period in time is likely to belong to the voice or to the noise is used in step S2 to estimate the spatial cue information for said sound source.

In case the method is initiated with not previous stored spatial cue information, the initial estimate may not produce a very accurate result. However, in cases where there is already spatial cue information stored, the estimate can determine a difference between the observed information and the already existing estimates, and further update the spatial cue information. This process is generally illustrated in steps S6 to S8. In step S6, an activity of a sound source is detected. Such detection for example comprises an assignment of a sound signal at a certain point to an already identified sound source. In the above example, an activity of the voice can be detected by evaluating the power level in the high frequency band. If the evaluated sound signal has a portion above a predetermined threshold in the high frequency band, then it is assumed to belong to the voice portion. If the observed power level in the frequency band is below the threshold, it may be more likely the noise signal.

The information concerning the activity is then used in S7 to restore the spatial cue of said signal using the already stored information. Further, the detected activity is used to update the stored spatial cue information in S8. The process of estimating and storing spatial cue information during detection of any activity is repeated continuously.

In addition, every now and then, that is with a frequency less than the repetition of steps S2, S3 and S6 to S8, external information from a second device is received in Step S4. Such external information can include any observed power of a sound signal over a certain period of time or at a certain point in time. For example the information received can include the observed power between the last transmissions of such information. The observed power in this regard can be the power in a specific frequency band, or the total power combining in all sound sources. The latter is referred to as envelope power.

By correlating the information on the received envelope power with its own measurement of the envelope power, the hearing device can determine any spatial changes in the sound sources. For example, the difference between the two envelopes powers changes, when the voice source moves during the last transmission. In correlating this difference with existing spatial cue information assigned with the respective sound source provides new spatial information. Consequently, the external information obtained at a much lower rate than the updates is used to update the spatial cue information of the identified sound sources in step S5. Again this process is then continuously repeated. The new updated spatial cue information is now used in step S10 to adjust a gain in the compressor to improve the spatial cue processing in the auditory system of the listener.

The disclosure enables a hearing device to obtain a higher accuracy in spatial cue information by a two-step procedure. The device updates stored spatial cue information of identified sound sources on a regular basis using the changes in the received sound signal. It further communicates with a second hearing device, although less frequent, and exchanges information related to the sound sources, for example the received averaged power between communication transmissions or similar information. The received information is used to update the previously estimated spatial cue information, which is then re-used for adjusting the output level of the sound signal to the listener.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

LIST OF REFERENCES

1A, 1B hearing device
2A, 2B, 2C sound analyser
3A, 3B difference estimator
3C ILD esitmator
4A, 4B communication device
5A, 5B antenna
6 communication link
7A, 7B microphone
71A, 71B connection
8A, 8B compressor
81A, 81B output
10, 11 sound source
21C, 22C elements
90, 91 inputs
93 ILD estimate output
100, 101 memory

The invention claimed is:

1. A hearing device comprising:
a microphone configured to receive sound signal from at least one sound source;
an estimator configured to estimate spatial cue information of the at least one sound source, wherein the estimator comprises an interaural level difference (ILD) estimator and/or an interaural time difference (ITD) estimator;
a compressor with a gain that is based on the spatial cue information; and
a communication device configured to communicate with a second hearing device;
wherein the hearing device is configured to identify the at least one sound source, detect an activity of the identified at least one sound source, and determine whether the activity exceeds a predetermined activity threshold; and
wherein the communication device is configured to communicate information related to the at least one sound source with the second hearing device upon the detected activity of the identified at least one sound source exceeding the predetermined activity threshold.

2. The hearing device of claim 1, wherein the compressor is configured to perform signal compression in frequency and/or amplitude.

3. The hearing device of claim 1, wherein the hearing device is configured to provide spatial cue of the at least one sound source based on the stored spatial cue information in response to the detected activity.

4. The hearing device of claim 1, wherein the hearing device is configured to update the spatial cue information of the at least one sound source upon the detection of the activity.

5. The hearing device of claim 1, wherein the hearing device is configured to synchronize data related to the spatial cue information of the at least one sound source with the second hearing device.

6. The hearing device of claim 1, wherein the information related to the at least one sound source comprises at least one of:
observed sound signal power over a certain period of time, at a certain point in time, or a combination thereof;
observed sound signal power depending on predetermined frequency bands;
observed power of the at least one sound source over a certain period of time, at a certain point in time, or a combination thereof;
observed power of another sound source over a certain period of time, at a certain point in time, or a combination thereof;
an averaged observed power of any of the above;
phase information about the sound signal or about the at least one sound source;
additional spatial cue information or source activity;
a combination of two or more of the foregoing.

7. The hearing device of claim 1, wherein the communication device is configured for wireless communication according to a Bluetooth standard, a Bluetooth low energy (BLE) protocol, or a protocol for near field communication (NFC).

8. The hearing device of claim 1, further comprising a sound analyser configured to determine or estimate a noise in the sound signal, and/or to separate a voice portion in the sound signal from a non-voice portion.

9. The hearing device of claim 1, wherein the spatial cue information includes a first spatial cue information related to a noise portion in the sound signal and a second spatial cue information related to a voice portion in the sound signal, and wherein the hearing device further includes a memory to store the first spatial cue information related to the noise portion in the sound signal, and the second spatial cue information related to the voice portion in the sound signal.

10. The hearing device of claim 1, wherein the hearing device comprises a hearing protector or a hearing aid.

11. The hearing device according to claim 1, further comprising a sound analyser configured to determine a contribution of the at least one sound source, wherein the sound analyser is different from the estimator.

12. The hearing device according to claim 11, wherein the sound analyser is configured to determine the contribution of the at least one sound source by comparing the sound signal to a threshold value.

13. The hearing device according to claim 1, further comprising a sound analyser configured to separate sound signals from different respective sound sources, the sound sources comprising the at least one sound source.

14. The hearing device according to claim 1, wherein the hearing device is configured to update the spatial cue information of the at least one sound source based on information received by the communication device.

15. The hearing device according to claim 14, wherein the gain of the compressor is based on the spatial cue information that has been updated based on the information received by the communication device.

16. A hearing device comprising:
a microphone configured to receive sound signals from different respective sound sources;
an estimator configured to estimate spatial cue information for at least one of the sound sources, wherein the estimator comprises an interaural level difference (ILD) estimator and/or an interaural time difference (ITD) estimator;
a compressor with a gain that is based on the spatial cue information; and
a communication device configured to communicate with a second hearing device;
wherein the hearing device is configured to distinguish one of the sound signals from another one of the sound signals, and to weight the spatial cue information based on a probability that the one of the sound signals is related to the at least one of the sound sources.

17. The hearing device according to claim 16, wherein the hearing device is configured to detect an activity of the at least one of the sound sources, and wherein the hearing device is configured to (1) provide spatial cue of the at least one of the sound sources based on the spatial cue information in response to the detected activity, and/or (2) update the spatial cue information for the at least one of the sound sources upon the detection of the activity.

18. The hearing device according to claim 16, further comprising a sound analyser configured to determine or estimate a noise in the sound signals, and/or to separate a voice portion in the sound signals from a non-voice portion.

19. The hearing device according to claim 16, wherein the spatial cue information includes a first spatial cue information related to a noise portion in the sound signals and a second spatial cue information related to a voice portion in the sound signals, and wherein the hearing device further includes a memory to store the first spatial cue information related to the noise portion in the sound signals, and the second spatial cue information related to the voice portion in the sound signals.

20. The hearing device according to claim 16, further comprising a sound analyser configured to determine a contribution of the at least one of the sound sources, wherein the sound analyser is different from the estimator.

21. The hearing device according to claim 20, wherein the sound analyser is configured to determine the contribution of the at least one of the sound sources by comparing the one of the sound signals to a threshold value.

22. The hearing device according to claim 16, further comprising a sound analyser configured to separate the sound signals from the different respective sound sources.

23. The hearing device according to claim 16, wherein the hearing device is configured to update the spatial cue information for the at least one of the sound sources based on information received by the communication device.

24. The hearing device according to claim 23, wherein the gain of the compressor is based on the spatial cue information that has been updated based on the information received by the communication device.

25. A hearing device comprising:

a microphone configured to receive sound signal from at least one sound source;

an estimator configured to estimate spatial cue information of the at least one sound source, wherein the estimator comprises an interaural level difference (ILD) estimator and/or an interaural time difference (ITD) estimator;

a compressor with a gain that is based on the spatial cue information; and a communication device configured to communicate with a second hearing device;

wherein the hearing device is configured to update the spatial cue information of the at least one sound source by combining the spatial cue information of the at least one sound source with another spatial cue information of another sound source.

26. The hearing device according to claim 25, wherein the hearing device is configured to detect an activity of the at least one sound source, and wherein the hearing device is configured to (1) provide spatial cue of the at least one sound source based on the spatial cue information in response to the detected activity, and/or (2) update the spatial cue information of the at least one sound source upon the detection of the activity.

27. The hearing device according to claim 25, further comprising a sound analyser configured to determine or estimate a noise in the sound signal, and/or to separate a voice portion in the sound signal from a non-voice portion.

28. The hearing device according to claim 25, wherein the spatial cue information includes a first spatial cue information related to a noise portion in the sound signal and a second spatial cue information related to a voice portion in the sound signal, and wherein the hearing device further includes a memory to store the first spatial cue information related to the noise portion in the sound signal, and the second spatial cue information related to the voice portion in the sound signal.

29. The hearing device according to claim 25, further comprising a sound analyser configured to determine a contribution of the at least one sound source, wherein the sound analyser is different from the estimator.

30. The hearing device according to claim 29, wherein the sound analyser is configured to determine the contribution of the at least one sound source by comparing the sound signal to a threshold value.

31. The hearing device according to claim 25, further comprising a sound analyser configured to separate sound signals from different respective sound sources, the sound sources comprising the at least one sound source.

32. The hearing device according to claim 25, wherein the hearing device is configured to determine the other spatial cue information of the other sound source.

33. The hearing device according to claim 25, wherein the hearing device is configured to receive the other spatial cue information from the second hearing device.

34. A hearing device comprising:

a microphone configured to receive sound signal from at least one sound source;

a sound analyser configured to determine a contribution of at least one sound source associated with the sound signal;

an estimator configured to estimate spatial cue information of the at least one sound source, wherein the estimator comprises an interaural level difference (ILD) estimator and/or an interaural time difference (ITD) estimator;

a compressor with a gain that is based on the spatial cue information; and a communication device configured to communicate with a second hearing device;

wherein the hearing device further includes a memory, and wherein the hearing device is configured to store the spatial cue information in a predetermined memory portion of the memory depending on whether the contribution of the at least one sound source is below a threshold value or not.

35. The hearing device of claim 34, wherein the sound analyser is configured to set the hearing device in a first operating mode if the contribution of the at least one sound source is below the threshold value, and to set the hearing device in a second operating mode if the contribution of the at least one sound source is above the threshold value.

36. The hearing device according to claim 34, wherein the hearing device is configured to detect an activity of the at least one sound source, and wherein the hearing device is configured to (1) provide spatial cue of the at least one sound source based on the spatial cue information in response to the detected activity, and/or (2) update the spatial cue information of the at least one sound source upon the detection of the activity.

37. The hearing device according to claim 34, wherein the sound analyser is configured to determine or estimate a noise in the sound signal, and/or to separate a voice portion in the sound signal from a non-voice portion.

38. The hearing device according to claim 34, wherein the spatial cue information includes a first spatial cue information related to a noise portion in the sound signal and a second spatial cue information related to a voice portion in the sound signal, and wherein the memory is configured to store the first spatial cue information related to the noise portion in the sound signal, and the second spatial cue information related to the voice portion in the sound signal.

39. The hearing device according to claim 34, wherein the sound analyser is different from the estimator.

40. The hearing device according to claim 34, wherein the sound analyser is configured to determine the contribution of the at least one sound source by performing sound separation.

41. The hearing device according to claim 34, wherein the sound analyser is configured to separate sound signals from different respective sound sources, the sound sources comprising the at least one sound source.

* * * * *